United States Patent [19]

Julian

[11] Patent Number: 4,979,692

[45] Date of Patent: Dec. 25, 1990

[54] CONVERTIBLE PALLET COIL AND REEL DECOILER

[76] Inventor: Joseph Julian, 23 Doe Meadow Ct., Southington, Conn. 06489

[21] Appl. No.: 498,917

[22] Filed: Mar. 26, 1990

[51] Int. Cl.[5] ..... B21C 47/16

[52] U.S. Cl. ..... 242/78.6; 242/45; 242/55; 242/78.7

[58] Field of Search ..... 242/78.6, 78.7, 45, 242/55, 75.5, 75.51, 105, 68.7, 128

[56] References Cited

U.S. PATENT DOCUMENTS

| | | | |
|---|---|---|---|
| 2,352,959 | 7/1944 | Littell | 242/78.7 |
| 2,865,576 | 12/1958 | Woellner | 242/78.7 |
| 4,249,705 | 2/1981 | Brooks et al. | 242/78.6 |
| 4,269,369 | 5/1981 | Stroup | 242/78.6 X |
| 4,582,271 | 4/1986 | Takahashi | 242/78.6 X |
| 4,848,694 | 7/1989 | Julian | 242/78.6 |

*Primary Examiner*—Stanley N. Gilreath
*Attorney, Agent, or Firm*—Dallett Hoopes

[57] ABSTRACT

A decoiling apparatus for strip or the like having a frame journaling a pair of spaced parallel powered rollers and a powered wheel on the frame out beyond and above the powered rollers. An arm is pivoted to the frame opposite the wheel and carries a freely spinnable turntable on its distal end. The unit is thereby convertible between a reel decoiler—wherein with the turntable arm up, the reel rests with its flanges on the powered rollers; and a pallet coil decoiler—wherein with the turntable down so that the underside of the turntable rides on the powered wheel the pallet coil is disposed flat on the powered turntable. Power unit measures the tension on the strip between the point of use and the decoiler and suitably speeds up or slows down the rollers and wheel to correspondingly speed up or slow down the decoiling.

7 Claims, 3 Drawing Sheets

CONVERTIBLE PALLET COIL AND REEL DECOILER

BACKGROUND OF THE INVENTION

1. Field of the Invention

This invention relates to decoilers for metal strip or wire and is structured to decoil from either a pallet coil or a traverse reel. More specifically, this invention is a convertible decoiler adapted to either support a pallet coil on its side for decoiling or a reel on its flanges. In either case speed controls assure smooth delivery of the strip material at the rate called for at the point of use.

2. Description of Related Art including Information Disclosed under §§1.97 to 1.99.

In the prior art there are patents which decoil pallet coils. An example is my own U.S. Pat. No. 4,848,694 which issued July 18, 1989. My earlier device includes a powered turntable for supporting the pallet, the drive being linked to a dancer arm around which the strip loops on its way to the point of use. The dancer arm operates outwardly from the periphery of the coil and is biased further outward still. It is linked to a speed control which in turn is connected to the turntable drive. By this means the pallet coil is rotated at the rate which the product is needed at its point of use.

Also in the art there are apparatuses for decoiling from a reel or traverse spool resting on its flanges on a pair of parallel rollers. An example is shown in the old U.S. Pat. No. 2,865,576 which issued Dec. 23, 1958 to H. L. Woellner. This patent teaches the use of a brake to slow down the spinning of the reel to prevent overrun of the reel on the rollers when the rate of takeoff of the wire off the reel is suddenly reduced.

Means for supporting a reel either about a vertical or horizontal axis is also disclosed in the old U.S. Pat. No. 2,353,651 which issued July 18, 1944 to H. H. Colson. The apparatus in this patent invariably supports the reel internally and does not provide drive means for powering the reel.

SUMMARY OF THE INVENTION

It is common today for both pallet storage and reel storage of strip material. To have separate decoilers for each of these two modes of storage is uneconomical, both from the standpoint of equipment cost and floor space.

There has been a need in the art, therefore, to provide a convertible decoiler including both a powered turntable for supporting a pallet coil and a pair of powered parallel horizontal rollers to support a reel on its flanges. Both the turntable and the rollers are supplied power at a rate depending on the demand for the strip material at its point of use. The turntable, when not in use, pivots up to give access to the rollers. Wben the turntable is down, it is engaged by the power wheel.

The drive means for the decoiler of the invention is permanently connected to the wheel and to the rollers. It is powered according to the tension on the strip between the decoiler and the point of use. The drive includes rollers and a wheel engaged by the underside of the turntable when it is pivoted downward in use. Idler wheels are also provided at the same level as the power wheel.

BRIEF DESCRIPTION OF THE DRAWINGS

Other features and objects of the invention will be clear to those skilled in the art by reading the following specification and reference to the drawings, all of which disclose a non-limiting embodiment of the invention. In the drawings.

DESCRIPTION OF THE PREFERRED EMBODIMENT

Figure 1:
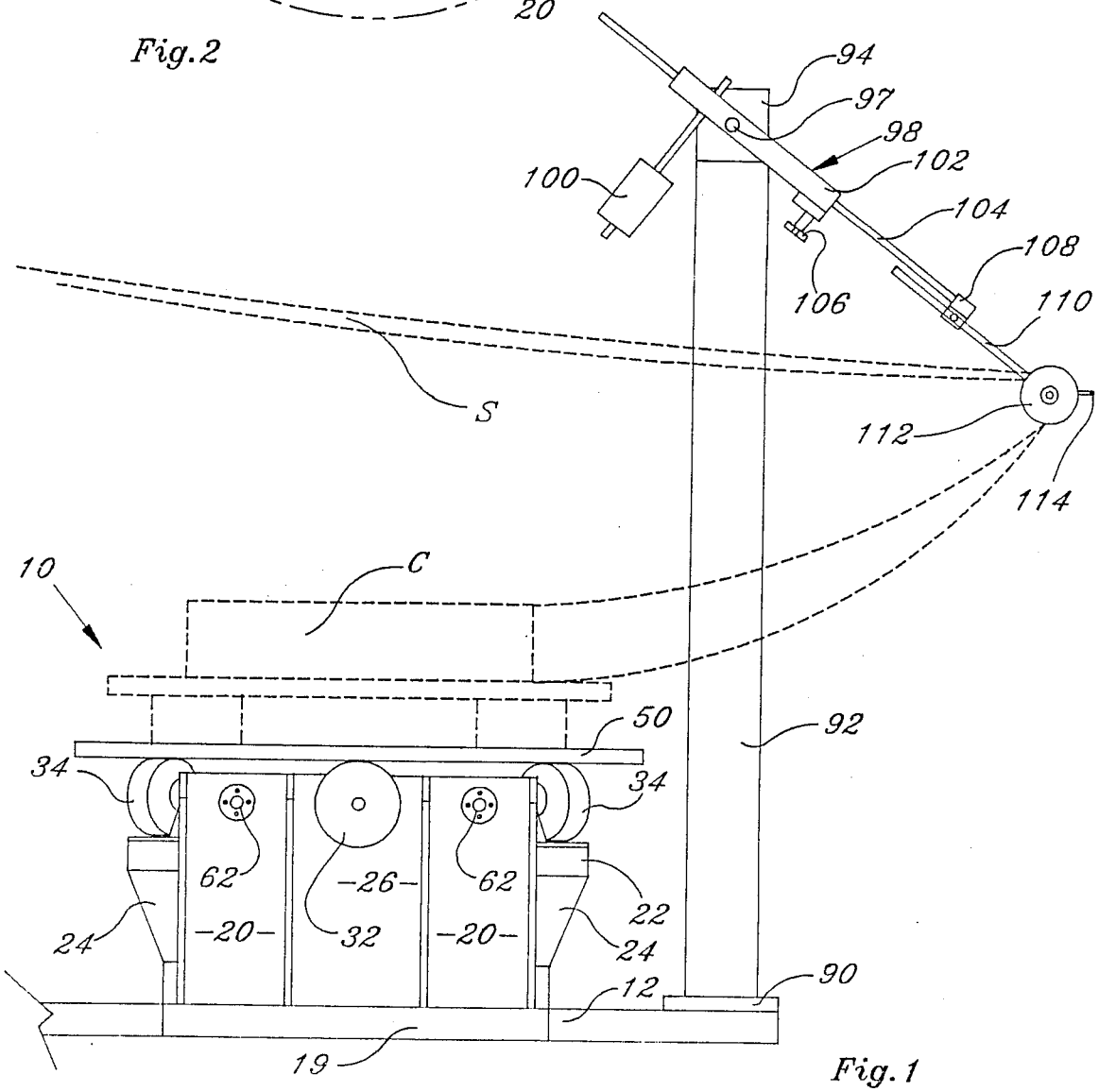
FIG. 1 is a front elevational view of an apparatus embodying the invention shown with the turntable down in position to decoil strip from a horizontal pallet.

Referring more specifically to the drawings, an apparatus embodying the invention is generally designated 10 in FIG. 1.

It includes a frame which comprises a base channel or plate 12 to which is secured a pair of upward channels 14 (FIG. 2) to define one of the side elements of the decoiler frame. Also to the plate 12 are secured a pair of outward angles 16 and an intermediate channel 18. The angles 16 and the channel 18 have their ends welded to an end angle 19 parallel to the base plate 12. Extending upward from the channel 18 are a pair of outwardly facing channels 20 which comprise the other side element of the frame.

An idler support plate 22 is secured along one side to the side elements 14 and a support web 24 extends upward from the elements 16 to support the other side.

The side elements 20 are connected adjacent their upper ends by a power wheel support plate 26. The support plate 26 is apertured and supports a bearing 28 which rotatably receives the power wheel drive shaft 30. A power wheel 32 is provided on the outer end of the shaft 30 while a power wheel drive sprocket 33 is mounted on the inner end thereof.

Idler wheels 34, which may be off-the-shelf pivotable caster wheels, are mounted facing upward on the opposite end of idler support plate 22. The upper surface of the power wheel 32 and the idler wheels 34 are arranged to be in the same plane.

Figure 5:
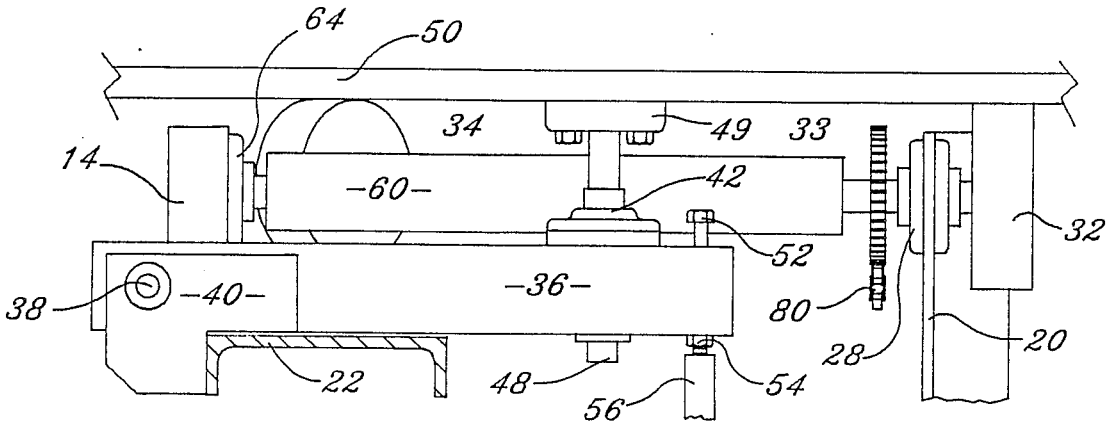
FIG. 5 is a sectional view taken on the line 5—5 of FIG. 2 and showing the support for the turntable.

A tubular turntable support arm 36 is shown in FIG. 5 and is mounted pivotally at one end by a pin 38 which extends between a pair of gudgeons 40 which are welded to the center of the idler wheel support plate 22. The pin 38 extends through bushings in the gudgeons 40 and through aligned openings in the arm 36.

At its remote end the arm (FIG. 4) carries a vertical bearing 42 through which is rotatably received the shaft 44 which carries a fixed support collar 46. A bushing 48 (FIG. 5) in the bottom wall of the arm is aligned with the bearing 42. It receives the lower end of the shaft 44. The upper end of the shaft carries a turntable support flange 49 to which the turn-table 50, shown in FIG. 5, is secured.

At its very end remote from the pin 38 the arm is provided with a level control stop bolt 52 which is threaded into a nut 54 welded to the bottom of the arm 36. The bottom of the bolt 52 rests against the support post 56 which is in turn supported by the channel 18. The turning of the bolt 52 will raise or lower the distal end of the arm 36 to preload the drive wheel.

Figure 4:
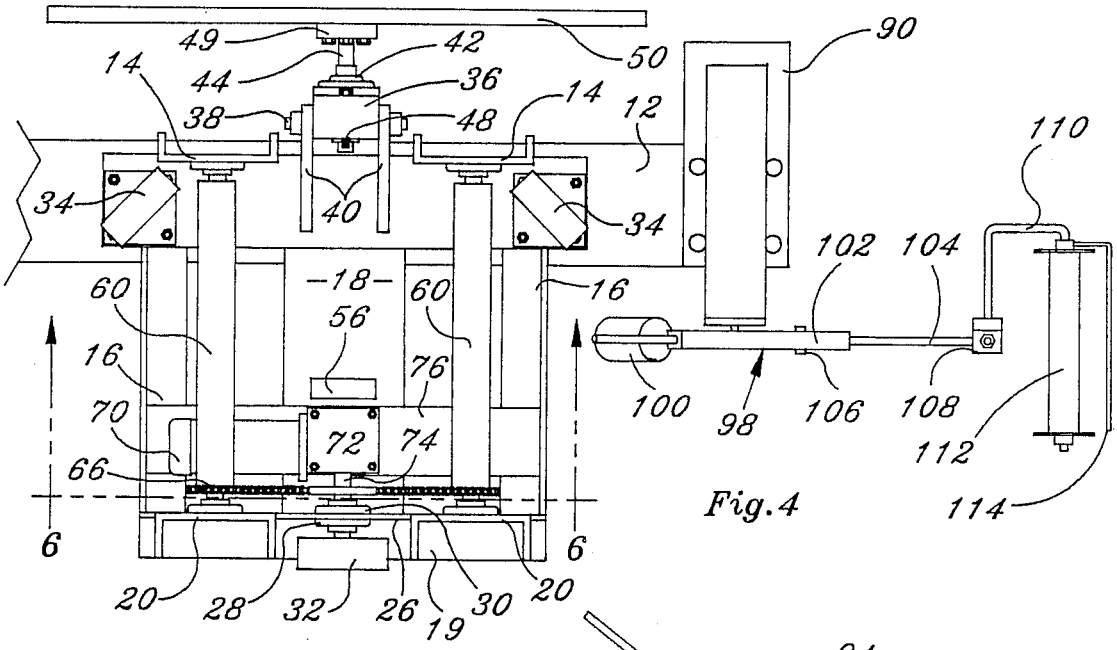
FIG. 4 is a view comparable to FIG. 2 but showing the turntable pivoted up out of the way for use decoiling from a reel.

A pair of reel-engaging horizontal rollers 60 are aligned, as best shown in FIG. 4. The rollers are supported by their shafts in bearings 62 disposed on the side elements 20 and bearing 64 disposed on the side elements 14. Adjacent the bearings 62 the rollers are provided with sprockets 66.

The power unit for the turntable and the rollers comprises an electric motor 70 (FIG. 2) including a speed reducer 72 which has an output shaft 74. The motor and its reducer are securely mounted on the platform 76 which superposes the two angles 16, and channel 18 and is secured thereto.

Figure 2:
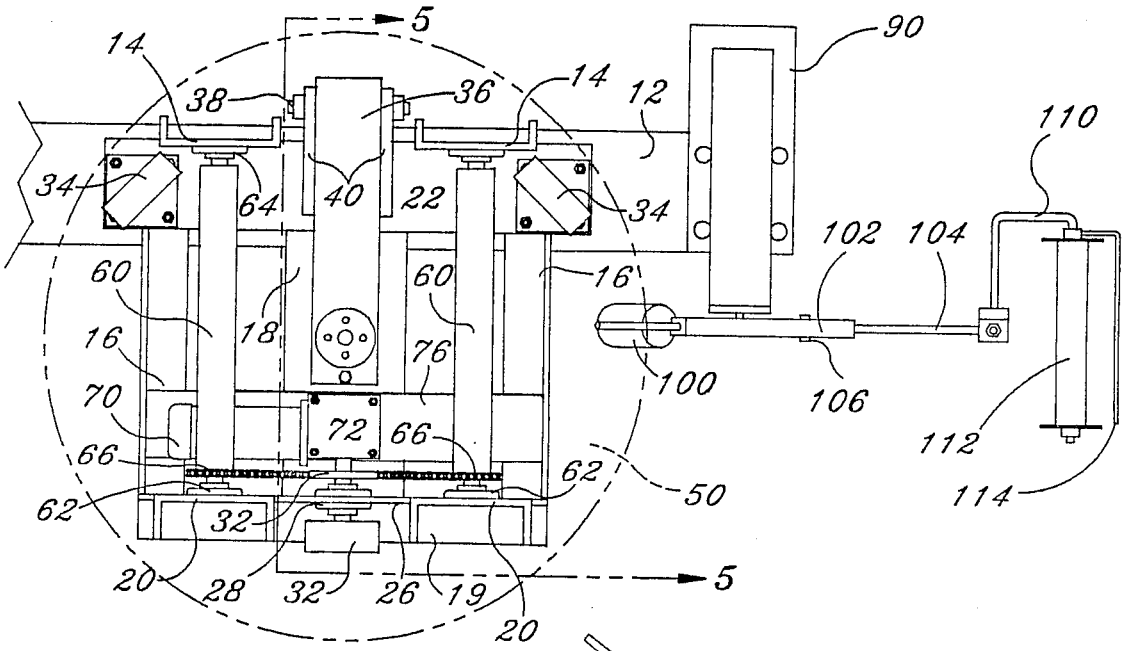
FIG. 2 is a top plan view of the apparatus as shown in FIG. 1, but showing the turntable, as indicated in broken lines, removed to reveal the drive assembly therebelow.
Figure 6:
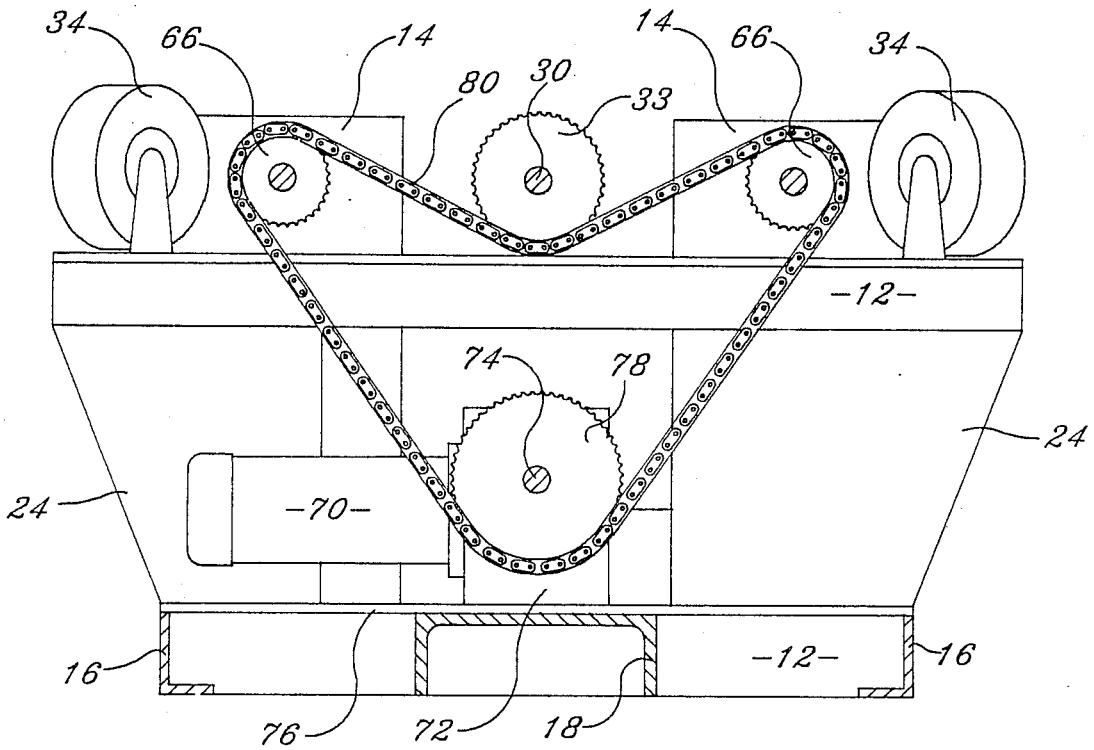
FIG. 6 is a sectional view taken on the line 6—6 of FIG. 4 and showing the chain drive means used for driving the rollers and power wheel.

The shaft 74 is provided with a sprocket 78 and the sprockets 78, 34, and 66 are aligned (FIGS. 2 and 4). Trained thereover preferably in the arrangement shown in FIG. 6 is roller chain 80. As a result, at all times as the drive shaft 74 turns the power wheel 32 and the rollers 60 rotate.

The level of rollers 60 is lower than the upper lever 32 and idlers 34 so that when the turntable is down in the position shown in FIG. 1 the rollers 60 do not interfere with the turning of the turntable 50. Further, with regard to design, the power wheel 32 as well as the idler wheels 34 are well outside the rollers 60 and do not interfere with the rotation of the rollers. Nor do they interfere with a reel R placed on the rollers as shown in FIG. 3.

Control for the drive motor 70 is as explained in my earlier patent mentioned above and appropriate portions of the disclosure are incorporated herein by reference. Briefly, the base plate 12 extends rightwardly (FIG. 2) from the drive assembly and a rearward extension plate 90 is secured to the end thereof. A mast 92 extends upward from the rear of the extension plate 90 and a horizontal boom 94 extends forwardly.

At its end it is provided with a shaft bearing and an adjustable dancer arm 98 is provided with a shaft 96 which journals in the shaft bearing. As is disclosed in my earlier patent, the shaft extending through bearing 96 controls the rheostat which is in circuit with the motor 70.

Figure 3:
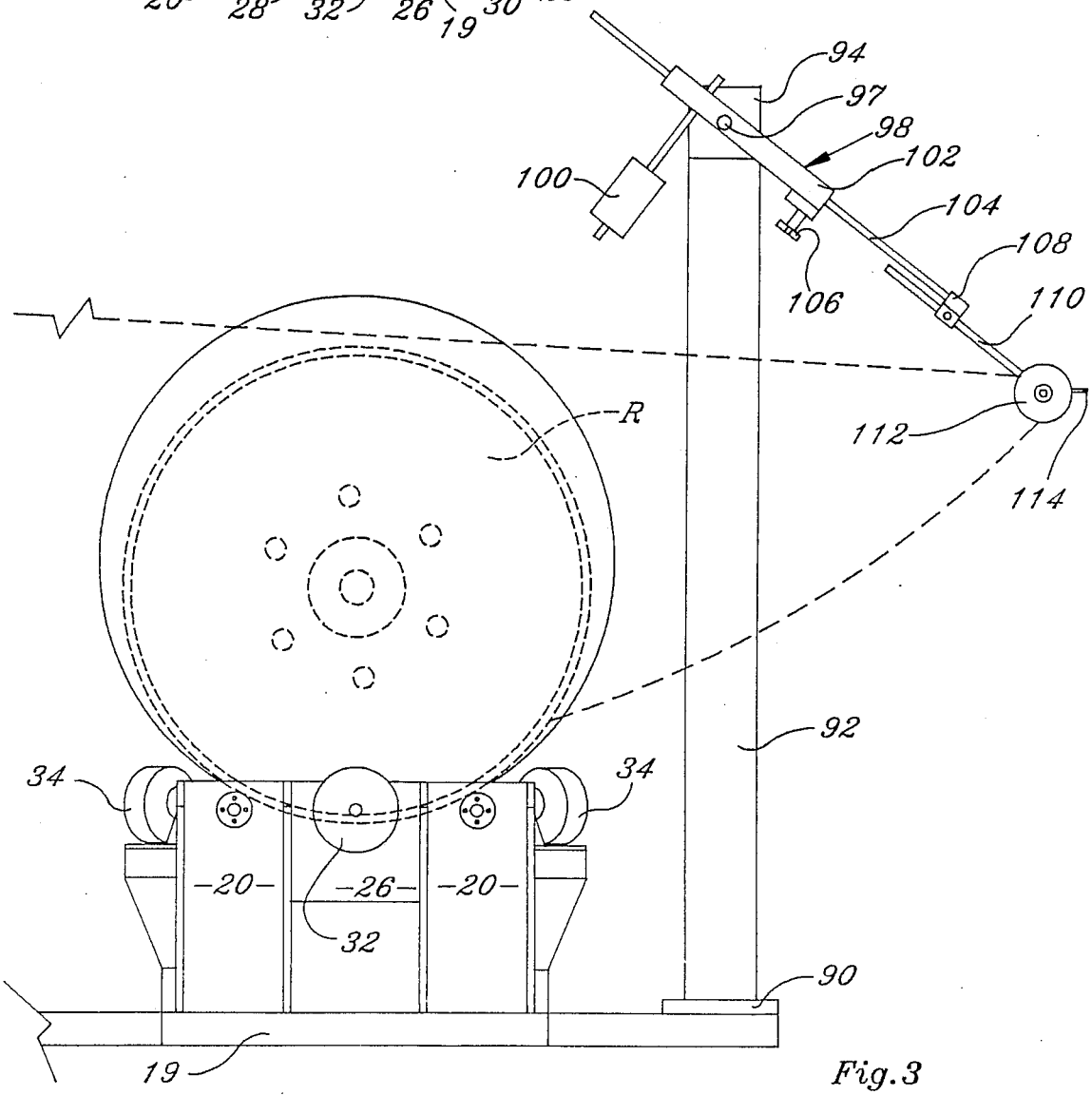
FIG. 3 is a side elevational view of the apparatus with the turntable pivoted up so that the apparatus may be used to decoil from a reel, shown in dotted lines.

As with my earlier patent, the dancer arm 98 is provided with a right angular arm with weight 100 biases the arm outward toward the position shown in FIGS. 1 and 3.

The length of the arm 98 is adjustable: The upper portion 102 to which the shaft 96 is attached telescopingly receives the rod 104, the position of which may be releasably fixed by a hand clamp 106. Similarly, the lower end of the rod 104 is formed with an adjustable clamp 108 which engages the spool support 110, preferably a U-shaped element (FIG. 2). The spool 112 pivots freely on the distal end of the U-shaped element 110 and a keeper 114 cantalevers over the reel, keeps the decoiling strip under control.

As with my earlier patent, when more strip is required at the point of use, the loop of strip about the spool 112 will move the spool leftwardly. This, according to the amount which the shaft 96 is turned adjusts the electric control to speed up the motor 70. When tension on the strip S slackens, the arm 98 returns to its position similar to that shown in FIGS. 1 and 3 and the power is cut to the motor 70, slowing it down.

It will be understood that the speed control for the motor 70, as thus described, will work well to control the speed of the rollers 16 and, hence, the rotation of the reel R as well as the speed of the power wheel 32 which will control the speed of rotation of the turntable 50. Hence, the same power package may be used irrespective of whether it is a flat coil C as in FIGS. 1 and 2 or a reel R as in FIGS. 3 and 4, which is being uncoiled.

As heretofore stated, the turntable 50 which is free to turn in the bearing 42 in the end of the arm 36 may be readily raised to the FIG. 4 position so that the operator will have easy access to the rollers 60 to support the reel R thereon. Alternatively, if it is desired to go to a pallet coil uncoiling operation, the reel R can be removed from the rollers 60, the turntable, the arm 36 can be pivoted down so that the turntable 50 covers the rollers 60 and the pallett and coil C can be placed on the turntable 50 as shown in FIG. 1. Means for driving the turntable 50 or the rollers 60 is as has been described.

It should be clear that the convertible decoiler as described offers efficient decoiling with economy of machinery cost as well as floor space. It is clear that there could be reasonable variations and modification of the structure described. The structure described does not limit the invention which may be defined by the following claim language and reasonable equivalents thereof.

What is claimed is:

1. A convertible decoiler for material from either a pallet coil or a reel comprising:

(a) a base frame including a pair of spaced side elements, (b) a pair of horizontally spaced parallel aligned elongate rollers extending between the side elements and journaled to rotate therebetween, (c) a power wheel journaled adjacent one of the side elements inbetween the rollers and having an axis parallel thereto, (d) a turntable for supporting a pallet, (e) a pivoted support arm pivoted to the frame opposite the power wheel for the turntable structured to support the turntable for free rotation about a vertical shaft on the arm and while the turntable rests on the power wheel, the arm being pivoted up out of the way when a supply reel rests with its flanges on the rollers, (f) variable speed power means for driving the rollers and the power wheel, (g) a vertical mast extending up to one side of the base frame, the mast having at its upper end a horizontal boom extend out over the frame, the boom having a proximate end attached to the mast and a distal end, a horizontal shaft bearing mounted in the distal end of the boom, (h) a dancer arm disposed in a vertical plane and having a fixed perpendicular shaft journaled in the shaft bearing and structured to have its lower end moving along a line extending outward beyond the periphery of its turntable, the arm being biased away beyond the periphery of the coil, the lower end having strap-engaging means thereon, (i) variable electrical resistive means associated with the shaft of the dancer arm and connected with the power means to relate the speed of the turntable to the angle of the dancer arm relative to the vertical whereby either with a pallet disposed flat on the turntable or a reel disposed on its flanges on the rollers and with the strip looped around the strip-engaging means on its way to point of use, decoiled material is supplied as needed.

2. A convertible decoiler as claimed in claim 1 wherein the rollers, the power means and the power wheel all have aligned sprockets and a chain is trained over all sprockets.

3. A convertible decoiler as claimed in claim 2 wherein the chain extends up over the roller sprockets and under the power wheel sprocket.

4. A convertible decoiler as claimed in claim 1 wherein a pair of idler wheels are provided to additionally support the turntable.

5. A convertible decoiler as claimed in claim 1 wherein the level of the top of the power wheel is higher than the level of the top of the rollers and the power wheel is disposed beyond the axial lengths of the rollers.

6. A convertible decoiler for strip from either a pallet coil or a reel comprising:

(a) a base frame including a pair of spaced side elements, (b) a pair of horizontally spaced parallel aligned elongate rollers extending between the side elements and journaled to rotate therebetween, (c) a power wheel journaled adjacent one of the side elements inbetween the rollers and having an axis parallel thereto, the top of the wheel being higher than the top of the rollers, and the power wheel is dropped beyond the axial length of the rollers, (d) a turntable for supporting a pallet, (e) a pivoted support arm for the turntable structured to support the turntable for free rotation about a shaft on the arm inbetween the rollers while the turntable rests on the power wheel, the arm being pivoted to the frame adjacent the opposite side element from the side element journalling the power wheel so that the arm can be pivoted up out of the way when a supply reel rests with its flanges on the rollers, (f) the rollers and the power wheel all having aligned sprockets respectively and a chain trained over the sprockets, (g) variable speed power means for driving the chain,

7. A convertible decoiler as claimed in claim 6 wherein a pair of idler wheels are provided to additionally support the turntable.

* * * * *